US010642197B2

(12) United States Patent
Verner et al.

(10) Patent No.: US 10,642,197 B2
(45) **Date of Patent: *May 5, 2020**

(54) GROUNDED INTERMEDIATE TRANSFER MEMBERS

(71) Applicant: HP INDIGO B.V., Amstelveen (NL)

(72) Inventors: Maty Verner, Ness Ziona (IL); Doron Schlumm, Kfar Harif (IL); Boaz Tagansky, Rishon Letzion (IL)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/555,414

(22) Filed: Aug. 29, 2019

(65) Prior Publication Data

US 2019/0384209 A1 Dec. 19, 2019

Related U.S. Application Data

(63) Continuation of application No. 15/569,340, filed as application No. PCT/EP2015/067064 on Jul. 24, 2015, now Pat. No. 10,423,096.

(51) Int. Cl.
*G03G 15/16* (2006.01)
*G03G 15/10* (2006.01)

(52) U.S. Cl.
CPC ..... *G03G 15/161* (2013.01); *G03G 15/10* (2013.01); *G03G 15/1675* (2013.01); *G03G 15/1685* (2013.01); *G03G 2215/1614* (2013.01); *G03G 2215/1619* (2013.01)

(58) Field of Classification Search
CPC ..... G03G 15/10; G03G 15/161; G03G 2215/1614; G03G 2215/1619; B41J 2/0057; B41J 2002/012
See application file for complete search history.

(56) References Cited

U.S. PATENT DOCUMENTS

| | | | | |
|---|---|---|---|---|
| 5,701,569 | A | 12/1997 | Kanazawa et al. | |
| 6,042,917 | A | 3/2000 | Schlueter et al. | |
| 6,887,558 | B2 | 5/2005 | Simpson et al. | |
| 10,423,096 | B2 * | 9/2019 | Verner | G03G 15/1685 |
| 2002/0106220 | A1 | 8/2002 | Nakashima et al. | |
| 2004/0062576 | A1 | 4/2004 | Saito et al. | |
| 2007/0084371 | A1 * | 4/2007 | Nagler | B41F 27/1231 101/415.1 |
| 2007/0172267 | A1 | 7/2007 | Nishida et al. | |
| 2010/0215405 | A1 | 8/2010 | Patton et al. | |

(Continued)

FOREIGN PATENT DOCUMENTS

| | | |
|---|---|---|
| EP | 0513547 | 11/1992 |
| EP | 0549195 | 6/1993 |

(Continued)

*Primary Examiner* — Thomas S Giampaolo, II
(74) *Attorney, Agent, or Firm* — Dicke Billig & Czaja PLLC

(57) ABSTRACT

A printing apparatus is described comprising a photoconductor for receiving an electrostatic charge pattern corresponding to an image, and one or more developers for applying a colorant to the photoconductor representative of the image. The apparatus further comprises a transfer member for transferring the image from the photoconductor onto a substrate, wherein the transfer member has a substantially grounded potential.

20 Claims, 2 Drawing Sheets

(56) References Cited

U.S. PATENT DOCUMENTS

| | | | | |
|---|---|---|---|---|
| 2012/0132093 | A1* | 5/2012 | Arraf ..... | B41N 10/04<br>101/401.1 |
| 2012/0237271 | A1 | 9/2012 | Sengoku | |
| 2013/0041069 | A1 | 2/2013 | Chun et al. | |
| 2013/0078014 | A1 | 3/2013 | Ogiyama | |
| 2018/0217519 | A1 | 8/2018 | Anufa | |

FOREIGN PATENT DOCUMENTS

| | | |
|---|---|---|
| JP | H06324575 | 11/1994 |
| JP | 08211754 | 8/1996 |
| JP | 11143255 | 5/1999 |
| JP | 2003005534 | 1/2003 |
| JP | 2005345912 | 12/2005 |

* cited by examiner

GROUNDED INTERMEDIATE TRANSFER MEMBERS

CROSS-REFERENCE

This Application is a Continuation of U.S. patent application Ser. No. 15/569,340, entitled "GROUNDED INTERMEDIATE TRANSFER MEMBERS", filed Oct. 25, 2017, which is a 371 of PCT Application No. PCT/EP2015/067064, entitled "GROUNDED INTERMEDIATE TRANSFER MEMBERS", filed Jul. 24, 2015, both of which are incorporated herein by reference.

BACKGROUND

Electro-photography printing forms an image on a substrate by selectively charging or discharging a photoconductive drum corresponding to an image to be printed. A colorant is applied to the charged drum and subsequently transferred to the substrate.

Liquid electro-photography ('LEP') uses inks as the colorants. An LEP printing device typically comprises a binary ink developer that applies the ink to a photoconductor.

The photoconductor subsequently transfers the ink to an Intermediate Transfer Member ('ITM') which is responsible for printing the image onto the substrate.

In between each duty cycle, LEP printing devices are cleaned with a view to maintaining high image quality unadulterated by the previous printing cycles. Ineffective cleaning can adversely affect print quality.

BRIEF DESCRIPTION OF THE DRAWINGS

Example implementations of the present disclosure will now be described by way of example, with references to the accompanying drawings, in which.

DETAILED DESCRIPTION

Examples of the present disclosure provide a printing apparatus and method where an intermediate transfer member ('ITM'), such as a belt or a drum, has a grounded potential. The grounded potential of the ITM removes the need to isolate the ITM. The grounded potential may also increase productivity when printing onto conductive substrates. Furthermore, the grounded ITM may aid in cleaning a photoconductor which may increase its lifespan and may also reduce the static electricity on the substrate resulting in improved substrate handling.

Figure 1:
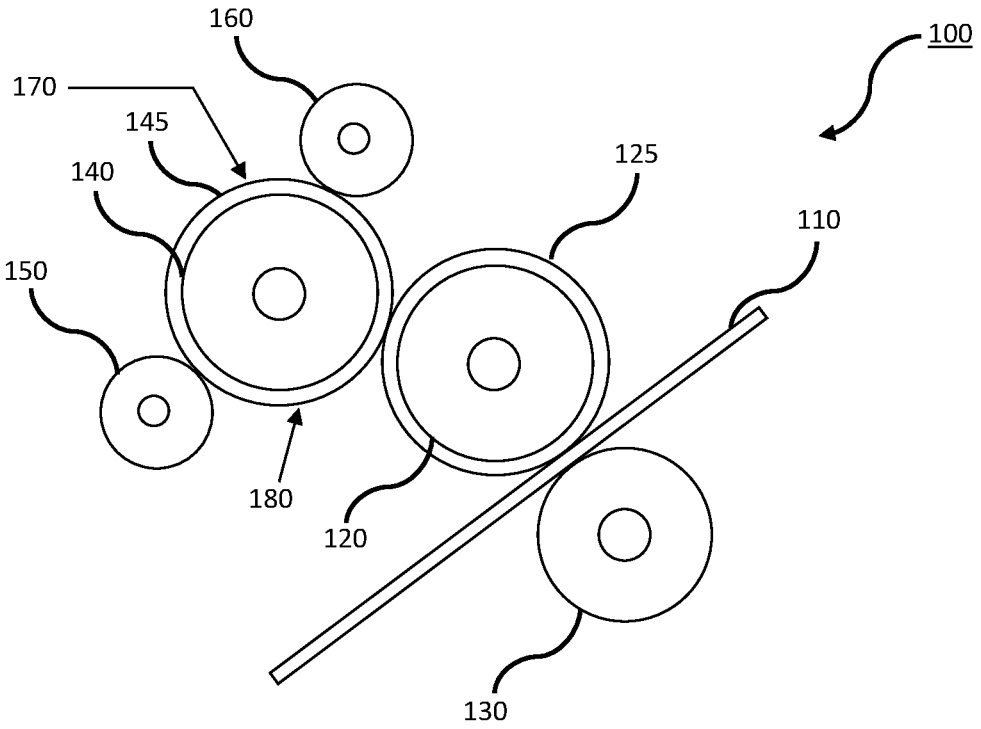
FIG. 1 shows an illustration of an example web press according to the present disclosure.

Referring to FIG. 1, there is shown a view of an example printing apparatus 100. The example printing apparatus 100 illustrated in FIG. 1 is a web press printer for printing images onto a web print medium. The apparatus may be adapted for printers where the print medium is sheet fed.

The printing apparatus 100 comprises an intermediate transfer member ('ITM') 120 and an impression member or roller 130. The ITM 120 is provided for receiving an image formed on a photoconductor 145 and transferring the image to a web substrate 110 which is brought into contact with the ITM 120 by the impression roller or cylinder 130. The photoconductor 145 may be a photo receptor sheet attached to a photo imaging plate ('PIP') in the form of a drum 140 on which the image is formed. The photoconductor 145 may receive charge from a charge roller 160, which in turn electrostatically attracts ink from a binary ink developer 150. The ITM 120 may have a transfer blanket 125 wrapped around an outer surface for receiving and transferring the image. The impression roller 130 may be moveable between an engaged position, in which the web substrate 110 is brought into contact with the ITM 120, and a disengaged position in which the web substrate 110 is not contacting or is free from the ITM 120. FIG. 1 shows the impression roller 130 in the engaged position.

The charge roller 160 has a large negative potential in turn charging the photoconductor 145. The PIP 140 may have a negative potential of at least −400V, such as −600V. The charge roller 160 may have a negative potential of at least −1500V, such as −1700V. Other suitable potentials may be used. The charge roller 160 charges the photoconductor 145 prior to a digitized discharge unit 170 which selectively discharges the selected parts of the photoconductor 145 to the potential of the PIP 140, forming an electrostatic charge pattern representative of an image. The digitized discharge unit 170 may be a laser writing head. For example, after exposure by the digitized discharge unit 170, areas where there may be a positive image, i.e. areas ink may be placed will have a lower potential; for example between −500V and −800V, such as −650V than areas where there will be no ink where the potential will be at least −1300V, such as −1500V. Other suitable potentials may be used.

After exposure by the digitized discharge unit 170, the photoconductor 145 moves with respect to the binary ink developer 150. The binary ink developer 150 is arranged such that ink is transferred to the photoconductor 140 in areas which have been discharged by the digitized discharge unit 170. As the photoconductor 145 moves with respect to the binary ink developer 150, the respective charges are such that the ink migrates from the binary ink developer 150 onto the areas of the surface of photoconductor 145 discharged by the digitized discharge unit 170. The ink will have a potential such that the potential of the areas of the surface of the photoconductor 140 where ink can be attracted may be modified. Following the binary ink developer, the discharged portions of the photoconductor 145, representative of the image will have a potential of between −1000V and −1100V, such as −1050V. Other suitable potentials may be used and other colorants may be used such as toner.

After receiving ink from the binary ink developer 150, but before transferring the ink to the ITM 120, a charging unit 180, which may comprise a light emitter such as a plurality of light emitting diodes, may be arranged to perform a pre-transfer erase ('PTE') on the photoconductor 145. The PTE removes any additional charge on the photoconductor 145 such that the potential of the photoconductor 145 generally matches the potential of the PIP 140. Charging unit 180 may be arranged to charge or discharge the photoconductor 145 to a uniform potential. When performing the PTE, the charging unit 180 discharges a portion of the photoconductor 145, such that the photoconductor 145 has the same substantially uniform electrostatic charge, for example at least −400V, such as −600V. This ensures a clean transfer of the image and avoids background charges from sparking to the ITM 120 or the transfer blanket 125 and prevents damage to the image. Other suitable potentials may be used.

Following the charging unit 180, a first transfer occurs where the image on the photoconductor 145 can be transferred onto the ITM 120 or the transfer blanket 125 surrounding the ITM 120. The transfer of the ink representing the image may be aided by the electrostatic force caused by a potential difference existing between the photoconductor 145 and the ITM 120. For example, the potential difference will be uniform electric field with a potential of at least 400V, such as 600V, from the photoconductor 145 to the ITM 120. This potential difference exists because of the grounded potential of the ITM 120 and the photoconductor 145 having a potential of at least −400V, such as −600V. The photoconductor 145 may be any other suitable voltage.

As the ITM 120 rotates, the ITM 120 surface, or the transfer blanket 125, comes into contact with the substrate 110. The substrate 110 can be pressed against the outer surface of the ITM 120 or the transfer blanket 125 by the impression roller 130. The impression roller 130 may also have a grounded potential. As a result, the ink image on the outer surface of the ITM 120 or the transfer blanket 125 can be transferred to the substrate 110.

During operation of LEP printing devices, sparks can be caused due to static electricity of the substrate. Furthermore, problems arise when printing onto a conductive substrate due to the maintenance of the ITM at a high voltage. Maintaining the ITM at such high voltage involves components to ensure the ITM is isolated and can support high loads.

Figure 2:
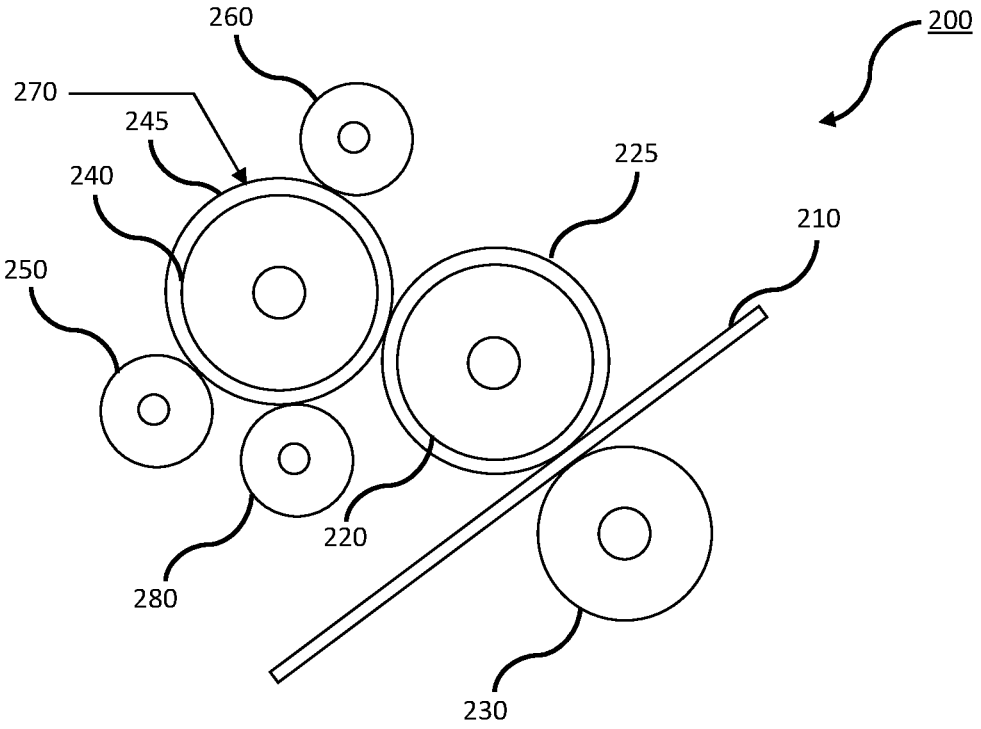
FIG. 2 shows an illustration of an example web press according to the present disclosure.

Referring to FIG. 2, there is shown a view of an example printing apparatus 200. The example printing apparatus 200 illustrated in FIG. 2 is a web press printer for printing images onto a web print medium. The apparatus may be adapted for printers where the print medium may be sheet fed.

The printing apparatus 200 comprises an intermediate transfer member ('ITM') 220 and an impression member or roller 230. The ITM can be provided for receiving an image formed on a photoconductor 245 and transferring the image to a main web substrate 210 which may be brought into contact with the ITM 220 by the impression roller or cylinder 230. The photoconductor 245 may be a photo receptor sheet attached to a photo imaging plate ('PIP') in the form of a drum 240 on which the image can be formed. The photoconductor 245 may receive charge from a charge roller 260, which in turn electrostatically attracts ink from a binary ink developer 250. The photoconductor 240 may also receive a further charge from a charging unit representative of a further charge rollers 280 to provide the photoconductor 240 with a substantially uniform electrostatic charge prior to transferring to the ITM 220. The ITM 220 may have a transfer blanket 225 wrapped around an outer surface for receiving and transferring the image. The impression roller 230 may be moveable between an engaged position, in which the web substrate 210 can be brought into contact with the ITM 220, and a disengaged position in which the web substrate 210 may not be contacting or may not be free from the ITM 220. FIG. 2 shows the impression roller 230 in the engaged position.

The charge roller 260 has a large negative potential in turn charging the outer surface of the photoconductor 245. The PIP 240 may have a grounded potential. For example, the charge roller may have a negative potential of −1100V. The voltage of the charge roller 260 may be another suitable potential.

The apparatus 200 of FIG. 2 follows much the same process as the apparatus 100 of FIG. 1, in that the digitized discharge unit 270 selectively discharges portions of the photoconductor 245 to the potential of the PIP 240 to form an electrostatic charge pattern representative of an image. The digitized discharge unit 270 may be a laser writing head. Following this the photoconductor 245 moves with respect to the binary ink developer 250 at which point ink can be electrostatically attracted to the portions of the photoconductor's 245 representative of the image to be printed. The other colorants such as toner may be used.

Following the binary ink developer 250, the photoconductor 245 receives a potential from the further charge roller 280. To enable the colorant to be electrostatically attracted from the PIP 240 to the outer surface of the ITM 220 or transfer blanket 225 surrounding it, both which have a grounded potential, a substantially uniform electrostatic charge may be applied to the PIP 240. The further charge roller 280 may have a negative potential of at least −600V, such as −700V, but other suitable voltages may be used. As such, a uniform electric field with a potential difference of at least 600V, such as 700V, from the photoconductor 245 to the ITM 220 will exist causing the ink on the photoconductor 245 to be electrostatically attracted towards the ITM 220.

As the ITM 220 rotates, the ITM 220 surface, or the transfer blanket 225, comes into contact with the substrate 210. The substrate 210 can be pressed against the outer surface of the ITM 220 or the transfer blanket 225 by the impression roller 230. The impression roller 230 may also have a grounded potential. As a result, the ink image on the outer surface of the ITM 220 or the transfer blanket 225 may be transferred to the substrate 210.

Figure 3:
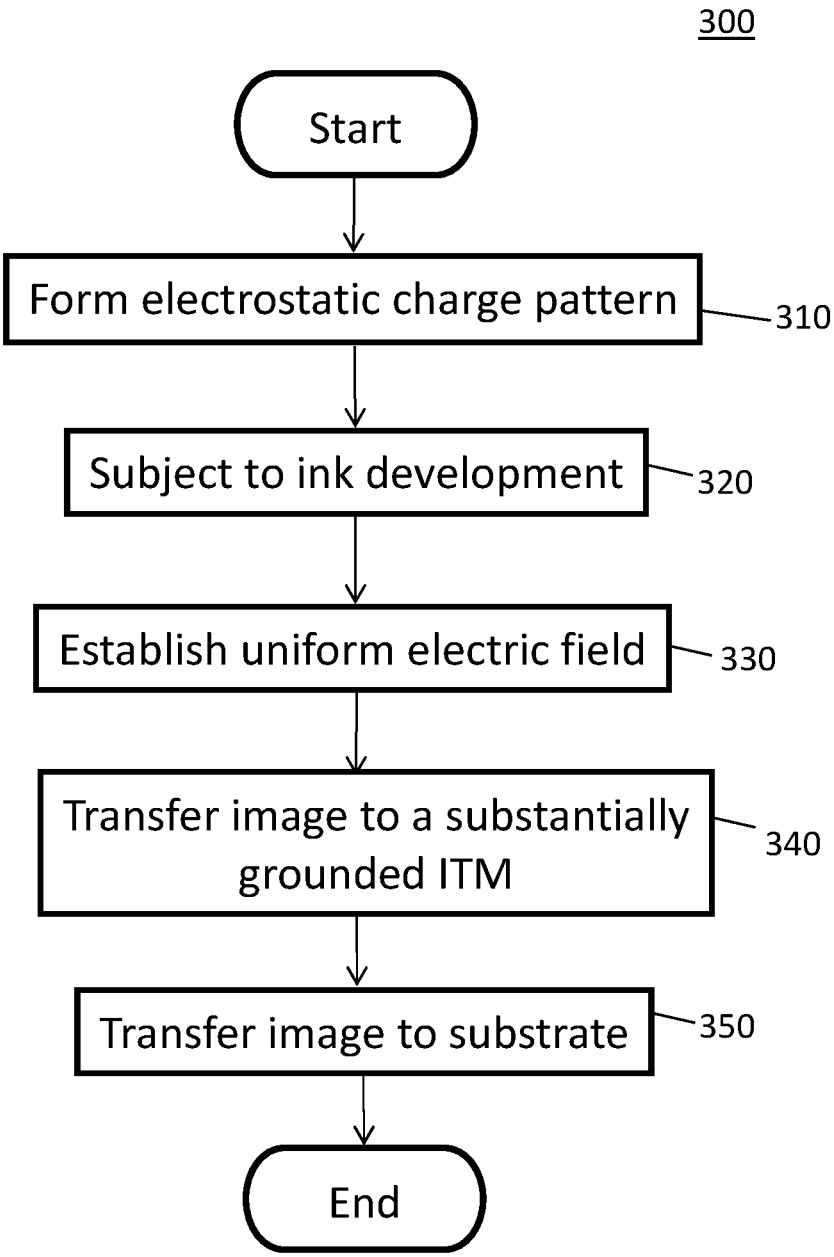
FIG. 3 shows an example method according to the present disclosure.

FIG. 3 illustrates an example method 300 according to the present disclosure. The method is a method of printing onto a substrate, wherein an ITM 120 has a grounded potential. The method 300 may be performed by a printing apparatus 100, 200 as shown in FIGS. 1 and 2.

In step 310, an electrostatic charge pattern representative of an image can be formed on a photoconductor 145, 245, such as a photo imaging plate ('PIP') in the form of a drum 140, 240 by a digitized discharge unit 170, 270. The digitized discharge unit 170, 270 selectively discharges portions of the photoconductor 145, 245 to the voltage of the PIP 140, 240 such that the electrostatic charge pattern representing the image may be formed on its surface. The PIP 140, 240 may have a negative potential such as described above in relation to FIG. 1, or may have a grounded potential as described above in relation to FIG. 2.

In step 320, the photoconductor 145, 245 moves with respect to the binary ink developer 150, 250, wherein ink can be electrostatically attracted to the areas representative of the image to be printed. The ink will have a potential such that the potential of the areas of the surface of the photoconductor 145. 245 where ink can be attracted may be modified. Other colorants may be used to form the image, such as toner.

In step 330, the photoconductor 145, 245 may be provided with a substantially uniform electrostatic charge by a charging unit so as to enable the ink to be electrostatically attracted to the ITM 120, 220 or the transfer blanket 125, 225 surrounding it which has a grounded potential. As described above in relation to FIG. 1, the PIP 140 has a negative potential of at least −400V, although other suitable negative potentials may be used, a substantially uniform electrostatic charge may be provided by way of a charging unit 180, which may be in the form of a plurality of light emitting diodes, performing a PTE. The PTE causes a homogenous conductivity across the photoconductor 145, such that the electrostatic charges caused by the charge roller 160 and the digitized discharge unit 170 are dissipated. This enables a clean transfer of the image to the ITM 120 or the transfer blanket 125. As described above in relation to FIG. 2, the PIP 240 has a grounded potential. Therefore, in order to facilitate the electrostatic potential to transfer the ink onto the ITM 220 or the transfer blanket surrounding it 225, a negative potential may be induced. To induce the negative potential the photoconductor 245 moves with respect to the further charge roller 280 representative of a charging unit. The further charge roller 280 may have a negative potential of at least −600V, such as −700V, although other suitable potentials may be used. The further charge roller 280 causes a homogenous electrostatic charge in the photoconductor 245 such that the image can be cleanly transferred to the ITM 220 or the transfer blanket 225 due to the difference in potentials.

In step 340, the image can be transferred to the ITM 120, 220 or the transfer blanket 125, 225. The ITM 120, 220 and any surrounding transfer blanket 125, 225 may have a grounded potential. The grounded potential of the ITM 120, 220 or transfer blanket 125, 225 reduces the cost of the press by removing the need to use expensive components to isolate the ITM 120, 220 from the web press. It also increases the productivity when using conductive substrates, preventing the build-up of static electricity in the substrate and improving substrate handling. Additionally, the grounded potential of the ITM 120, 220 can aid in the cleaning of the photoconductor 145, 245 increasing its lifespan. The image may be transferred by the difference in the electrostatic charges between the ITM 120, 220 and the photoconductor 145, 245.

At step 350, the image can be transferred from the ITM 120, 220 or transfer blanket 125, 225, to the substrate 110, 210. This may be achieved by bringing the substrate 110, 210 into contact with the ITM by means of an impression roller 130, 230. The impression roller may also have a grounded potential. The impression roller 130, 230 may be moveable between an engaged position, in which the web substrate 110, 210 can be brought into contact with the ITM 120, 220, and a disengaged position in which the web substrate 110, 210 may not be contacting or free from the ITM 120, 220. FIGS. 1 and 2 show the impression roller 130, 230 in the engaged position.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

The invention claimed is:

1. A printing apparatus comprising:
a photo imaging plate;
a photoconductor attached to the photo imaging plate, the photoconductor to receive an electrostatic charge pattern corresponding to an image;
a developer to apply a colorant to the photoconductor corresponding to the image;
an intermediate transfer member to transfer the image from the photoconductor onto a substrate, the intermediate transfer member having a grounded potential; and
a transfer blanket wrapped around an outer surface of the intermediate transfer member.

2. The printing apparatus of claim 1, further comprising:
an impression roller to bring the substrate into contact with the intermediate transfer member.

3. The printing apparatus of claim 2, wherein the impression roller has a grounded potential.

4. The printing apparatus of claim 1, wherein the photoconductor comprises a photo receptor sheet.

5. The printing apparatus of claim 1, further comprising:
a charge roller to apply a negative potential of at least −400V to the photoconductor.

6. The printing apparatus of claim 5, further comprising:
a digitized discharge unit to selectively discharge portions of the photoconductor to provide the electrostatic charge pattern corresponding to the image.

7. The printing apparatus of claim 1, wherein the developer comprises a binary ink developer.

8. The printing apparatus of claim 1, wherein the transfer blanket receives the image from the photoconductor and transfers the image to the substrate.

9. The printing apparatus of claim 1, further comprising:
a charging unit to perform a pre-transfer erase on the photoconductor to remove any additional charge on the photoconductor such that the potential of the photoconductor matches the potential of the photo imaging plate.

10. The printing apparatus of claim 9, wherein the charging unit comprises a light emitter.

11. The printing apparatus of claim 1, wherein the photo imaging plate has a grounded potential.

12. The printing apparatus of claim 1, wherein the transfer blanket has a grounded potential.

13. The printing apparatus of claim 1, wherein the colorant comprises a toner.

14. A printing apparatus comprising:
a photo imaging plate having a grounded potential;
a photoconductor attached to the photo imaging plate, the photoconductor to receive an electrostatic charge pattern representative of an image;
a developer to apply a colorant to the photoconductor representative of the image; and
an intermediate transfer member to transfer the image from the photoconductor onto a substrate, the intermediate transfer member having a grounded potential.

15. The printing apparatus of claim 14, further comprising:
a charge roller to apply a negative potential of at least −1100V to the photoconductor.

16. The printing apparatus of claim 14, further comprising:
a charging unit to provide the photoconductor with a uniform electrostatic charge prior to transferring the image to the intermediate transfer member.

17. The printing apparatus of claim 14, further comprising:
a digitized discharge unit to selectively discharge portions of the photoconductor to form the electrostatic charge pattern representative of the image.

18. The printing apparatus of claim 17, wherein the digitized discharge unit comprises a laser writing head.

19. The printing apparatus of claim 14, further comprising:
a transfer blanket wrapped around an outer surface of the intermediate transfer member, the transfer blanket having a grounded potential.

20. A method of printing onto a substrate, the method comprising:

forming an electrostatic charge pattern representative of an image on a photoconductor attached to a photo imaging plate having a grounded potential;

developing the image on the photoconductor using a colorant;

transferring the image from the photoconductor onto a grounded intermediate transfer member; and transferring the image from the intermediate transfer member to a substrate.

* * * * *